US006429858B1

(12) United States Patent
Janssen et al.

(10) Patent No.: US 6,429,858 B1
(45) Date of Patent: Aug. 6, 2002

(54) APPARATUS HAVING A DAC-CONTROLLED RAMP GENERATOR FOR APPLYING VOLTAGES TO INDIVIDUAL PIXELS IN A COLOR ELECTRO-OPTIC DISPLAY DEVICE

(75) Inventors: Peter J. Janssen, Scarborough; Lucian R. Albu, New York, both of NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/537,826

(22) Filed: Mar. 29, 2000

(51) Int. Cl.[7] ..... G09G 5/00
(52) U.S. Cl. ..... 345/204; 345/213
(58) Field of Search ..... 345/99, 98, 100, 345/94, 204, 690, 211, 212, 213

(56) References Cited

U.S. PATENT DOCUMENTS 5,021,774 A * 6/1991 Ohwada et al. ..... 345/90
5,801,674 A * 9/1998 Shimizu ..... 345/103
5,812,104 A * 9/1998 Kapoor et al. ..... 345/76
6,011,535 A * 1/2000 Katoh et al. ..... 345/100
6,067,061 A * 5/2000 Friedman ..... 345/205
6,137,432 A * 10/2000 Xiao ..... 341/155
6,320,565 B1 * 11/2001 Albu et al. ..... 345/88
6,329,974 B1 * 12/2001 Walker et al. ..... 345/100

* cited by examiner

*Primary Examiner*—Amare Mengistu
*Assistant Examiner*—Nitin Patel

(57) ABSTRACT

In an electro-optic display device, such as a liquid crystal display device which serves as a modulator for projected light, a global DAC controlled ramp generator is used in conjunction with track and hold circuit for each column of the display to convert incoming digital display signals to analog signals for all columns. Row address circuitry addresses each row of the display, thereby to address the individual pixels of the display device with such analog signals. The limitation on an increase in frame rate, resulting from the finite conversion time (cycle time) of the DAC and the finite speed of the track and hold circuits, is overcome by providing a multi-phase clock and multiplexer which enables a selection from among several analog levels during each ramp cycle.

5 Claims, 3 Drawing Sheets

APPARATUS HAVING A DAC-CONTROLLED RAMP GENERATOR FOR APPLYING VOLTAGES TO INDIVIDUAL PIXELS IN A COLOR ELECTRO-OPTIC DISPLAY DEVICE

CROSS-REFERENCE TO RELATED APPLICATION

The subject matter of this application is related to that disclosed in the commonly assigned U.S. patent application Ser. No. 09/375,952, filed Aug. 17, 1999 entitled "DAC DRIVER CIRCUIT WITH PIXEL RESETTING MEANS AND COLOR ELECTRO-OPTIC DISPLAY DEVICE AND SYSTEM INCORPORATING SAME", and in the commonly assigned U.S. patent application Ser. No. 09/469, 449, filed Dec. 21, 1999 entitled "APPARATUS HAVING A DAC-CONTROLLED RAMP GENERATOR FOR APPLYING VOLTAGES TO INDIVIDUAL PIXELS IN A COLOR ELECTRO-OPTIC DISPLAY DEVICE".

BACKGROUND OF THE INVENTION

The invention relates to color display systems which employ one or more electro-optic display devices. Such a display device serves as a light modulator, either in the reflective or transmissive mode, to control the grey level of projected light at each pixel point. More particularly, the invention relates to such a color display system having ramp generator circuitry for generating a saw-tooth analog signal and circuitry to address the individual pixels of the display device with such an analog signal.

Color display systems are known in which light bars of different colors are sequentially scrolled across a single electro-optic light modulator panel to produce a color display. See, for example, commonly assigned U.S. Pat. No. 5,532,763, incorporated herein by reference.

These display systems are particularly suitable for displaying color information in the form of continuously updated image information signals arranged in successive frames, such as color video information, in which each frame is composed of component color sub-frames, e.g., red, green and blue sub-frames.

These systems employ an electro-optic light modulator panel comprised of a row-and-column matrix array of pixels, for modulating light in accordance with the image information signals during successive frame periods. The analog signal information is applied to the pixel columns of the array, a row at a time, during each frame period.

A system of this type is also disclosed in the publication of J. A. Shimizu, "Single Panel Reflective LCD Projector", *Projection Displays V,* Proceedings SPIE, Vol. 3634, pp. 197–206 (1999). In such a system, a plurality of column pixel driver circuits receive a common ramp signal which is repeatedly generated, during a plurality of cycles, by the output buffer of a digital-to-analog converter (DAC) controlled ramp generator. Each column driver is coupled to all the pixels in a column of the electro-optic display device. During each ramp cycle, the column driver applies a prescribed voltage, corresponding to a desired pixel brightness level, to a pixel in a particular row in the respective column.

The pixels in a column are selected by a row control circuit which selects successive pixel rows during successive ramp cycles.

In a system of this type, the DAC controlled ramp generator and/or the column driver circuits become a performance "bottleneck" at higher frame rates (greater than 120 frames/second) which are desirable to reduce color artifacts and flicker. As the frame rate is increased, the finite conversion time (cycle time) of the DAC and the finite switching time of the column drivers pose a limitation on the maximum speed of operation.

The Japanese Patent No. 5-297833 discloses a driving circuit for a display which is similar in many respects to the system described above. In this case, a step wise increasing (or decreasing) waveform is applied to a sample and hold circuit. When the staircase ramp reaches a desired level, this circuit samples and holds that voltage for presentation to a pixel on the display in a particular row. The staircase ramp is generated by two step wise waveform voltage circuits which vary the staircase ramp in course steps and fine steps, respectively.

SUMMARY OF THE INVENTION

It is a principal object of the present invention to provide a circuit which will permit an increase in the frame rate in an electro-optic display without increasing the cost of hardware, and without reducing the number of grey levels (brightness levels) which can be applied to each pixel.

This object, as well as other objects which will become apparent from the discussion that follows, are achieved, in accordance with the present invention, by providing a column driver control circuit which enables a selection (sampling) from among two or more analog levels during each basic clock cycle. This is accomplished by selecting from among a plurality of phase-shifted waveforms generated by a multiphase clock.

The present invention thus affords an improvement in speed in a system for applying various levels of voltage to the individual pixels in an electro-optic display device having a matrix of pixels arranged vertically in columns and horizontally in rows. This system includes:

(a) a digital clock for producing a digital clock timing pulse signal at a first clock timing rate;

(b) a digital counter, connected to the digital clock for counting clock timing pulses and repetitively producing a ramp cycle signal upon receipt of a prescribed number of clock pulses;

(c) a ramp generator, coupled to the digital counter for producing a substantially monotonic ramp voltage signal during each ramp cycle;

(d) a number of column drivers, one for each column of the display device, which includes a sampling circuit, coupled to the pixels in the respective column of the display device, for storing the ramp voltage signal when it reaches a prescribed value corresponding approximately to a particular, desired brightness level of a pixel in the respective column and in a particular row during a given ramp cycle;

(e) a column control circuit, coupled to all of the column drivers, for causing respective ones of the sampling circuits to sample and store the ramp voltage signal upon receipt of the next clock timing pulse after the ramp voltage signal reaches the prescribed value for each respective column; and (f) a row control circuit for repeatedly selecting one or more pixel rows which receive the voltage signals stored in the sampling circuits of the column drivers.

According to the invention, the column control circuit includes (1) a multiphase clock, coupled to the digital clock, for producing a plurality of phase-shifted waveforms, each waveform providing a trigger pulse, for triggering the sampling circuit of the respective column drivers to store the instantaneous ramp voltage signal, and (2) a plurality of column selection circuits, one for each column, for selecting the one of the plurality of waveforms which causes the associated column driver to trigger at the moment when the ramp voltage signal most closely corresponds to the desired brightness level of a particular pixel in the respective column.

Preferably, the digital counter produces a second digital signal which changes in successive steps at the first clock timing pulse rate, during each ramp cycle, and which repeats such changes during a plurality of successive ramp cycles; and the ramp generator includes a digital-to-analog converter (DAC) for producing a first voltage signal having a value corresponding to the second digital signal. This first voltage signal, which may have sudden, stepwise changes in value, can be smoothed by a filter so as to be substantially monotonic during each ramp cycle.

In a preferred embodiment of the present invention, the digital signal source comprises a first clock pulse generator, operating at the first clock timing rate, and a first counter coupled to the first clock pulse generator and supplying a pulse count, during each ramp cycle, to the DAC. In this embodiment, the column control circuit comprises, in combination:

(1) a second clock pulse generator operating at the second clock timing rate;

(2) a second counter, operating at the second clock timing rate and connected to the second clock pulse generator for counting the clock pulses produced thereby;

(3) a plurality of data registers, each associated with one column of the display, for receiving and storing a digital number corresponding to the brightness level of a pixel in a particular row of the associated column;

(4) a comparator, connected to the second counter and to the data register, for comparing the digital numbers in the counter and the register and producing an output signal when the numbers are equal;

(5) a master latch, reset by the clock pulse generator and coupled to the comparator for storing the output signal for one clock period at the first clock timing rate;

(6) a multiphase clock driver connected to the second clock pulse generator for producing a plurality of third clock pulse signals having different phases with respect to each other;

(7) a multiplexer, coupled to receive the plurality of third clock pulse signals from the multiphase clock driver, for selecting one of the third clock pulse signals; and (8) a plurality of slave latches, each associated with one column of the display and reset by the multiplexer and coupled to the master latch, each slave latch producing a second output signal for controlling one of the column drivers.

This arrangement permits the sampling rate of the column control circuit to be increased by a multiple of the clock pulse rate of the first clock pulse generator, thus increasing the grey scale resolution without increasing the conversion rate of the DAC and/or the speed of operation of the column drivers of the display device.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
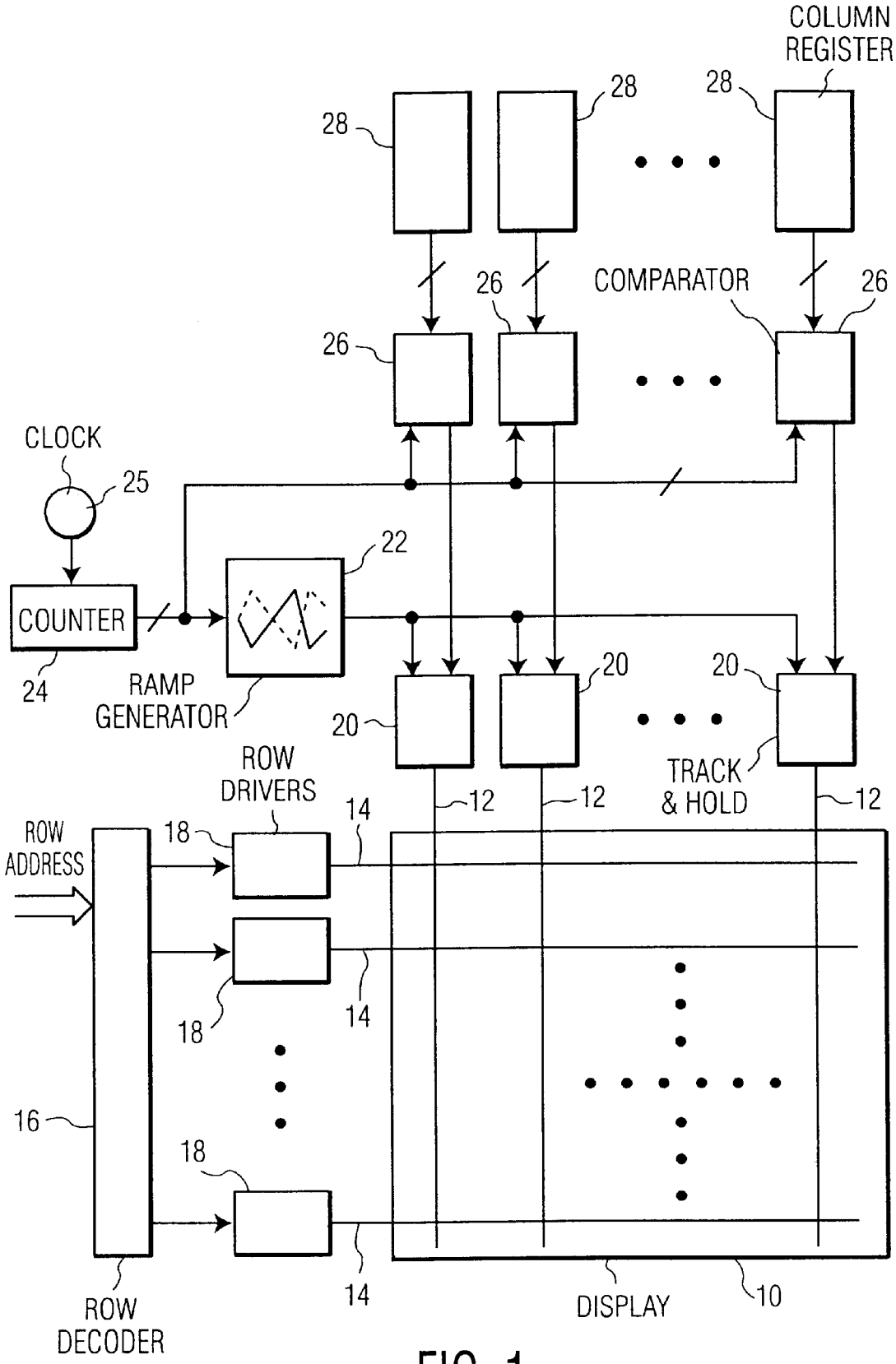
FIG. 1 PRIOR ART
FIG. 1 is a block diagram of an analog electro-optic light modulator panel, and its associated driver circuits, of the type to which the present invention relates.

The preferred embodiments of the present invention will now be described with reference to FIGS. 1–4 of the drawings. Identical elements in the various figures are designated with the same reference numerals.

FIG. 1 illustrates a typical arrangement for controlling and driving an electro-optic display device. In this arrangement, a liquid crystal display or light modulator 10 has a matrix of pixels arranged vertically in columns and horizontally in rows. These pixels are located at the intersections of the column conductors 12 and the row conductors 14. The column conductors 12 provide analog voltages to the pixels in each column whereas the row conductors 14 provide a switching voltage to each associated row, permitting the column voltages to be supplied to the pixels of that row.

Rows are successively addressed in a prescribed order by means of a row decoder 16 which activates successive ones of the row drivers 18.

Column voltages are supplied by column driver circuits 20 which are realized as track and hold circuits. These track and hold circuits receive a ramp voltage from a ramp generator 22. The ramp generator 22 receives a signal from a counter 24 that counts pulses produced by a clock 25. The count commences either from some minimum number or maximum number and increases or decreases, respectively, until it reaches, at the opposite end of the scale, a maximum or minimum number, respectively. The counter then produces a "ramp cycle signal" indicating the start of a new ramp cycle, and is reset to commence counting anew. The ramp generator 22 thus produces an increasing or decreasing ramp signal, in repetitive cycles—i.e., a "saw tooth signal"—as determined by the ramp cycle signal.

The output of the counter 24 is also supplied to a number of comparators 26, one for each column. This number is then compared in each comparator to a digital number representing the desired brightness level of a pixel in the associated column. The number representing this brightness level is stored in an associated pixel register 28 during each complete cycle of the system.

When the count supplied by the counter 24 is equal to the digital number stored in a pixel register, the respective comparator 26 produces a pulse which is passed to the track and hold circuit 20 for that column. Upon receiving such an enable pulse, the associated column driver 20 stores a voltage equal to the instantaneous output of the ramp generator 22.

Upon completion of each ramp cycle, the voltages stored in the column driver circuits are supplied to the pixels in a particular row selected by the row drivers 18.

Figure 2:
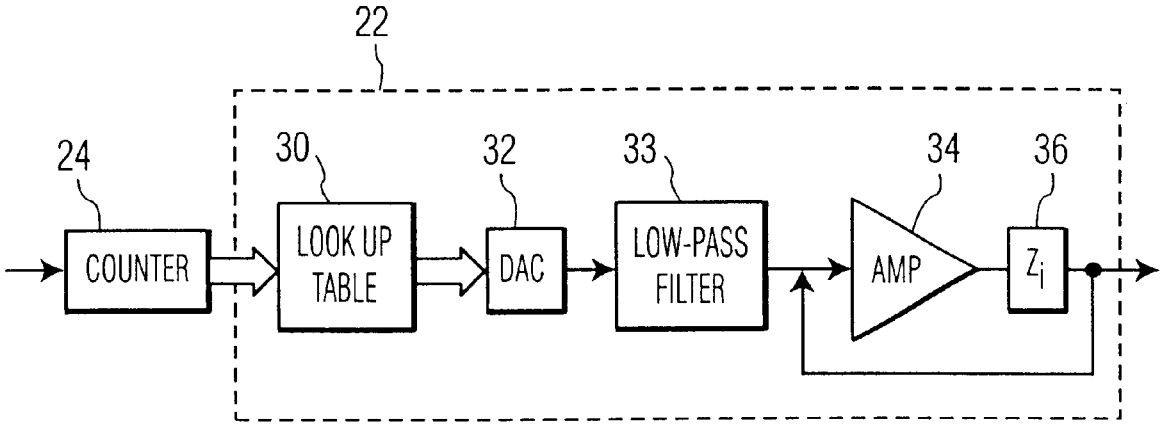
FIG. 2 is a block diagram of a digital-to-analog converter (DAC) ramp generator which may be used with the system of FIG. 1.

FIG. 2 illustrates a ramp generator 22 which may be used in the circuit of FIG. 1. In response to each clock pulse, the counter 24 increments its output which is supplied as an address to a look-up table 30. The LUT supplies the contents of this address, a digital number, to a DAC 32. During the period between successive clock pulses, this DAC converts the digital number to a first analog voltage signal. This first voltage signal is then passed to a low pass filter 33 which has the effect of removing the voltage "steps" in the first signal and thus producing a second voltage signal with a substantially constant first derivative during each ramp cycle. This second voltage signal is then passed globally to all column drivers 20 (FIG. 1) via a ramp buffer amplifier 34. The buffer amplifier serves to isolate the ramp waveform from the load and other disturbances. The low intrinsic output impedance $Z_i$ of the buffer output stage 36 is further reduced by feedback.

The operational speed of the system of FIG. 1 is limited by (1) the conversion time of the DAC 32—that is, the minimum time within which the DAC can convert a digital number to an analog voltage—and (2) the speed of operation of the column drivers—that is, the track and hold circuits 20, the comparators 26 and the column registers 28.

Figure 3:
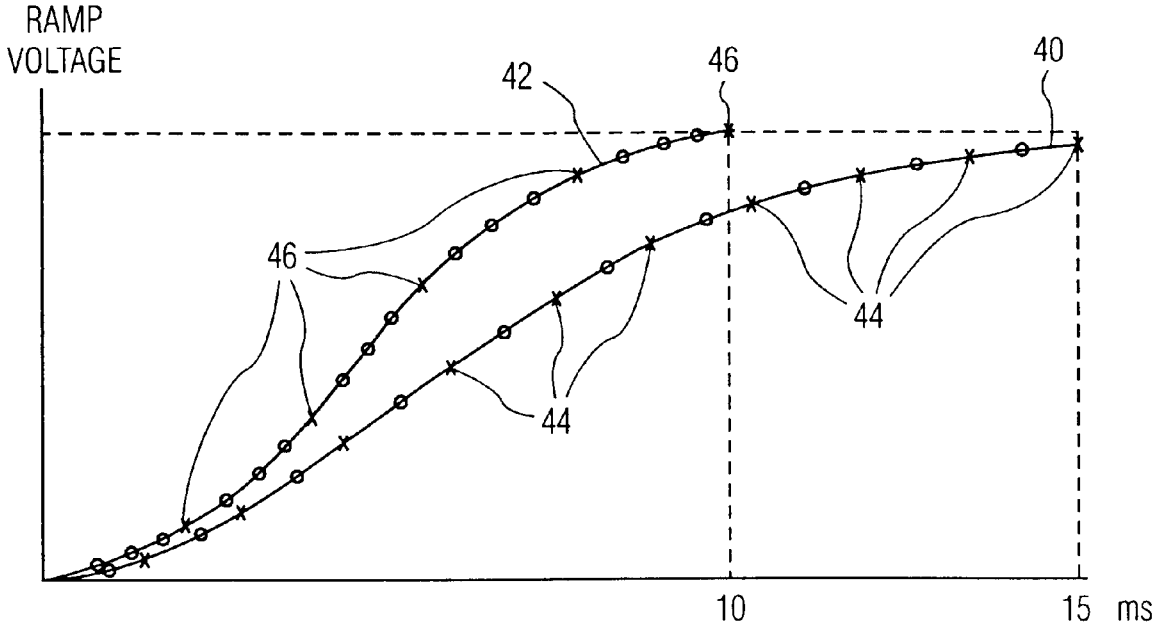
FIG. 3 is an explanatory diagram (not to scale) illustrating the operation of the DAC ramp generator of FIG. 2 and illustrating the concept of the present invention.

FIG. 3 shows a ramp voltage 40 (lower line) which has been generated from ten digital numbers (indicated by the x's 44), each successively higher than the next, by a look-up table 30 in a circuit of the type shown in FIG. 2. Since the total time allocated to this ramp 40 is 15 ns, each digital number must be supplied and converted within a time period of 1.5 ns. If this conversion time of 1.5 ns is the minimum time required by the DAC, the ramp 40 cannot be generated at a faster rate. This places an upper limitation on the speed of the clock 25 and counter 24, and thus the frame rate of the system of FIG. 1.

According to the invention, the look-up table 30 may be programmed to provide larger voltage steps to the DAC in response to successive addresses received from the counter 24. This permits the ramp period (ramp cycle time) to be reduced, as indicated by the ramp voltage 42 (upper line) in FIG. 3, and the frame rate thereby increased. As may be seen, the ramp 42 is generated in five equal steps (voltage levels 46, indicated by the x's) rather than ten. Even though the entire ramp is generated in only 10 ns, rather than 15 ns as in the case of the ramp 40, the DAC conversion time, between the individual steps (indicated by the "x" on each ramp 40 and 42) is longer for the ramp 42 than for the ramp 40.

Whereas FIG. 3 shows a relatively course resolution for the ramps 40 and 42 (ten steps and five steps, respectively), it will be understood that in practice the ramp will be generated with a resolution of 256 steps (8 bits) or even greater (up to 10 bits).

The present invention makes it possible to increase the frame rate of the system without sacrificing display performance or increasing cost. Although it would be possible to provide two DACs and to alternate their use for odd and even rows of the display device, such a modification would substantially increase the cost of the display. Also, it would be possible to utilize fast ECL logic in the column drivers, instead of the slower CMOS logic, but this would also increase the cost of the system.

According to the invention, the resolution (grey scale) of the display may be increased by controlling the column drivers to sample the ramp waveform at a rate which is faster than the clock rate of the DAC. Thus, in the ramp 40, the column drivers are clocked at a rate which is exactly twice that of the DAC. Consequently, the column drivers are clocked not only at the instants of time indicated by the x's 44 on the ramp 40, but also at the instants of time indicated by the 0's 48.

Ramp 42 illustrates the case where the sampling rates of the column drivers are increased to four times that of the clock rate of the DAC. In this case, the ramp voltage signal Whereas FIG. 3 shows a relatively course resolution for the ramps 40 and 42 (ten steps and five steps, respectively), it will be understood that in practice the ramp will be generated with a resolution of 256 steps (8 bits) or even greater (up to 10 bits).

The present invention makes it possible to increase the frame rate of the system without sacrificing display performance or increasing cost. Although it would be possible to provide two DACs and to alternate their use for odd and even rows of the display device, such a modification would substantially increase the cost of the display. Also, it would be possible to utilize fast ECL logic in the column drivers, instead of the slower CMOS logic, but this would also increase the cost of the system.

According to the invention, the resolution (grey scale) of the display may be increased by controlling the column drivers to sample the ramp waveform at a rate which is faster than the clock rate of the DAC. Thus, in the ramp 40, the column drivers are clocked at a rate which is exactly twice that of the DAC. Consequently, the column drivers are clocked not only at the instants of time indicated by the x's 44 on the ramp 40, but also at the instants of time indicated by the 0's 48.

Ramp 42 illustrates the case where the sampling rates of the column drivers are increased to four times that of the clock rate of the DAC. In this case, the ramp voltage signal is sampled twenty times (rather than five) during the 10 ns interval.

According to a particular feature of the present invention, the sampling rates of the column drivers are increased, without increasing the conversion speed of the DAC, and/or the operating speed of the column drivers, by controlling a master latch with the most significant part of the data word representing the desired pixel brightness, and then a slave latch with the least significant part, using a multi-phase clock and a multiplexer.

Figure 4:
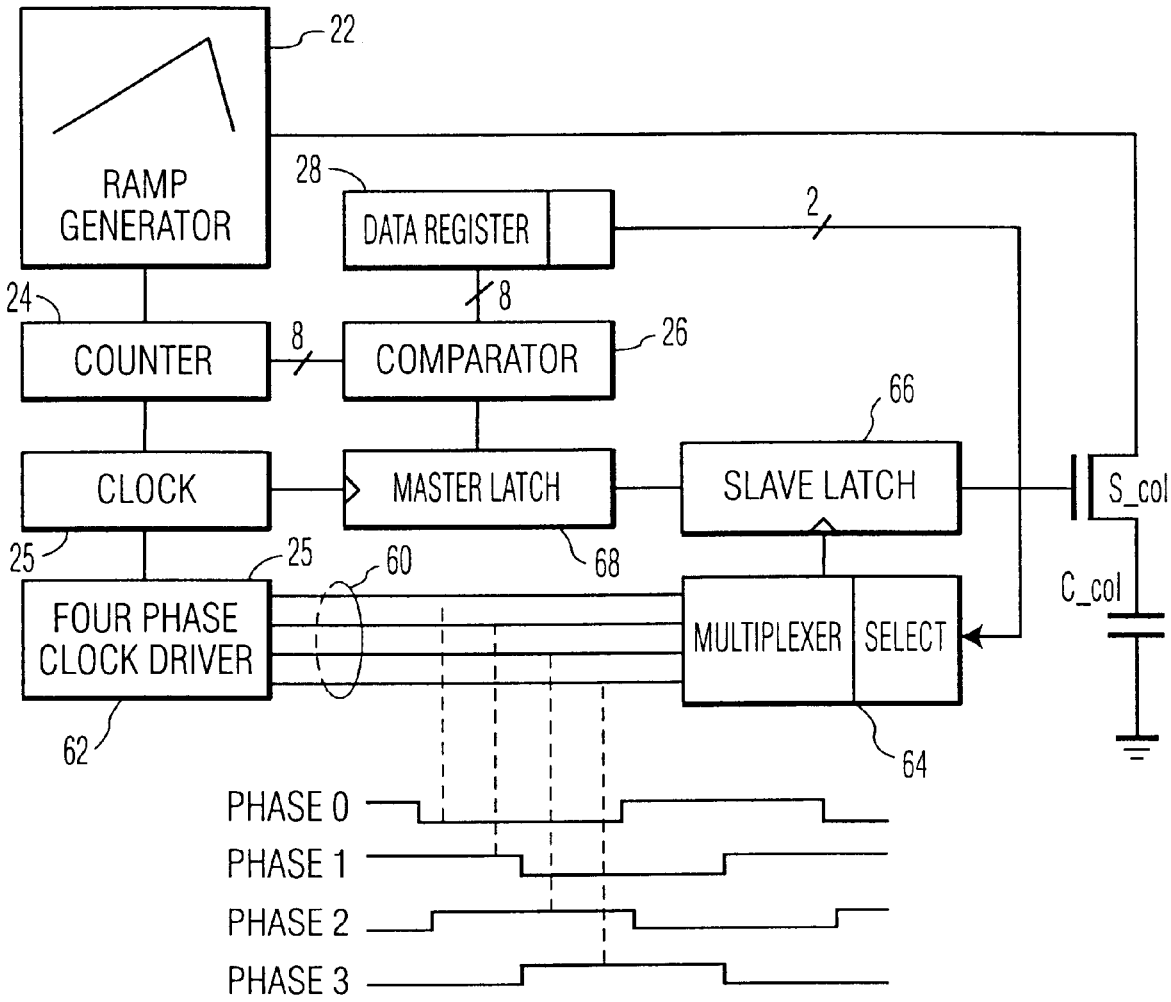
FIG. 4 is a block diagram of the preferred embodiment of a digital control circuit for the system of FIG. 1 according to the present invention.

FIG. 4 illustrates the preferred embodiment of the present invention which implements this concept. As before, the counter driven ramp generator 22 produces an analog ramp voltage during each ramp cycle which is tracked by all the column drivers 20 in the display. Only one column driver is shown in FIG. 4 for reasons of clarity. When the counter 24 reaches the value stored in the column data register 28, the comparator 26 outputs a signal that activates the column switch. After sampling—that is, after opening the transistor switch $S_{col}$—the instantaneous ramp voltage is stored on the column capacitor $C_{col}$ for the remainder of the ramp cycle and then transferred to a pixel in a particular row. In the known method, the precise moment of sampling was determined by a single clock signal produced by the clock pulse generator 25.

In this embodiment, a delayed clock signal is selected from a group of phase-shifted clock pulses, enabling a selection from several analog levels within one clock period.

As shown in FIG. 4, the signals on the four line bus 60 are generated in a PLL-based multi-phase clock driver circuit 62. This clock driver circuit receives clock pulses at the first clock timing rate and generates four phase delayed pulses, with different relative phases. These phase-shifted clock pulses, appearing on separate lines 60, are illustrated at the bottom of FIG. 4. The two least significant bits (LSB's) of the data word in the column data register 28 (which bits remain the same during an entire ramp cycle) determine which of the four clock lines will be used for sampling. A multiplexer 64, controlled by the LSB data, selects the appropriate clock phase in accordance with the LSB's and triggers a slave latch 66 that was previously enabled by a master latch 68. The slave latch opens the switch $S_{col}$ to hold the instantaneous voltage on the capacitor $C_{col}$.

There has thus been shown and described a novel apparatus having a DAC-controlled ramp generator for applying voltages to individual pixels in a color electro-optic display device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In apparatus for applying various levels of voltage to individual pixels in a display device having a matrix of pixels arranged vertically in columns and horizontally in rows, said apparatus comprising:

(a) a digital clock for producing a digital clock timing pulse signal at a first clock timing rate;

(b) a digital counter, connected to the digital clock, for counting clock timing pulses and repetitively producing a ramp cycle signal upon receipt of a prescribed number of clock pulses;

(c) a ramp generator, coupled to the digital counter for producing a substantially monotonic ramp voltage signal during each ramp cycle;

(d) a number of column drivers, one for each column of the display device, which includes a sampling circuit, coupled to the pixels in the respective column of the display device, for storing the ramp voltage signal when it reaches a prescribed value corresponding approximately to a particular, desired brightness level of a pixel in the respective column and in a particular row during a given ramp cycle;

(e) a column control circuit, coupled to all of the column drivers, for causing respective ones of the sampling circuits to sample and store the ramp voltage signal upon receipt of the next clock timing pulse after the ramp voltage signal reaches the prescribed value for each respective column; and (f) a row control circuit for repeatedly selecting one or more pixel rows which receive the voltage signals stored in the sampling circuits of the column drivers;

the improvement wherein said column control circuit includes (1) a multiphase clock, coupled to the digital clock, for producing a plurality of phase-shifted waveforms, each waveform providing a trigger pulse, for switching the sampling circuit of the respective column drivers to store the instantaneous ramp voltage signal, and (2) a plurality of column selection circuits, one for each column, for selecting the one of the plurality of waveforms which causes the associated column driver to switch at the moment when the ramp voltage signal most closely corresponds to the desired brightness level of a particular pixel in the respective column.

2. The apparatus defined in claim 1, wherein the digital counter produces a second digital signal which changes in value in successive steps at the first clock timing pulse rate, during each ramp cycle, and which repeats such changes during a plurality of successive ramp cycles; and the ramp generator includes a digital-to-analog converter (DAC) for producing a first voltage signal having a value corresponding to the second digital signal.

3. The apparatus defined in claim 2, wherein the ramp generator includes a filter, coupled to the DAC, for smoothing the first voltage signal to produce the ramp voltage during each ramp cycle.

4. The apparatus defined in claim 2, wherein said column control circuit comprises, in combination:

(1) a plurality of data registers, each associated with one column of the display, for receiving and storing a digital number corresponding to the desired brightness level of a pixel in a particular row of said associated column;

(2) a plurality of comparators, each associated with one column of the display and connected to said digital counter and a respective one of said data registers, for comparing the digital numbers in said counter and said one register and producing an output signal when said numbers are equal;

(3) a plurality of master latches, each associated with one column of the display, reset by said digital clock and coupled to a respective one of said comparators, for storing the output signal of the comparator for one clock period at said first clock timing rate;

(4) a plurality of multiplexers, each associated with one column of the display, coupled to receive at least one least significant bit (LSB) from its associated data register and said plurality of phase-shifted waveforms from said multiphase clock, for selecting one of said phase-shifted waveforms in accordance with said LSB; and (5) a plurality of slave latches, each associated with one column of the display and enabled by said multiplexer and said master latch, each slave latch producing a second output signal for controlling one of said column drivers.

5. The apparatus defined in claim 1, wherein each of said sampling circuits is a track and hold circuit.

* * * * *